US006219635B1

(12) United States Patent
Coulter et al.

(10) Patent No.: US 6,219,635 B1
(45) Date of Patent: Apr. 17, 2001

(54) INSTANTANEOUS DETECTION OF HUMAN SPEECH PITCH PULSES

(76) Inventors: Douglas L. Coulter, Box 239 HC 67, Floyd, VA (US) 24091; David C. Coulter, 9613 Pembroke Pl., Vienna, VA (US) 22182

( * ) Notice: Subject to any disclaimer, the term of this patent is extended or adjusted under 35 U.S.C. 154(b) by 0 days.

(21) Appl. No.: 09/200,339

(22) Filed: Nov. 25, 1998

Related U.S. Application Data

(60) Provisional application No. 60/066,880, filed on Nov. 25, 1997.

(51) Int. Cl.[7] ..... G10L 11/04
(52) U.S. Cl. ..... 704/207; 704/213
(58) Field of Search ..... 704/205–209, 704/213, 214, 235

(56) References Cited

U.S. PATENT DOCUMENTS

| | | | | |
|---|---|---|---|---|
| 3,335,225 | | 8/1967 | Campanella et al. | 704/209 |
| 4,581,491 | | 4/1986 | Boothroyd | 607/118 |
| 4,783,807 | * | 11/1988 | Marley | 704/235 |
| 4,982,433 | * | 1/1991 | Yajima et al. | 704/208 |
| 5,127,053 | * | 6/1992 | Koch | 704/207 |

* cited by examiner

*Primary Examiner*—David D. Knepper

(57) ABSTRACT

Pitch is tracked for a selected source process characterized by a pitch source having many harmonics followed by a bandpass filtering (e.g., human speech or other common processes). The filtering in the original source process causes an original pitch pulse to be seen in somewhat modified form and followed by ringing at band pass filter frequencies. Often, the ringing produces peaks of unpredictable amplitude, a characteristic making it difficult to use simplistic methods such as picking waveform amplitude peaks. The method of the present invention avoids such difficulties by taking into account relative phase of harmonics associated with the basic pitch rate or frequency (F0). Since the bandpass filters in the original process produce ringing in frequencies other than the original fundamental frequency, the instantaneous phase of each of the ringing frequencies are only temporally aligned or lined up well for the duration of the original pitch pulse (i.e., the pitch pulse sinusoidal half cycle) whereas for later ringing-created peaks, this phase alignment is not observed . A computational trap door or efficient algorithm has been developed to check for the phase aligned case and is part of the method of the present invention. The algorithm essentially looks for squareness in a candidate pulse (i.e., a positive sinusoidal half cycle which may or may not be a pitch pulse, as defined above), thereby indicating that at least all of the odd order harmonics are substantially in phase with the fundamental pitch (F0).

10 Claims, 6 Drawing Sheets

110
120
124

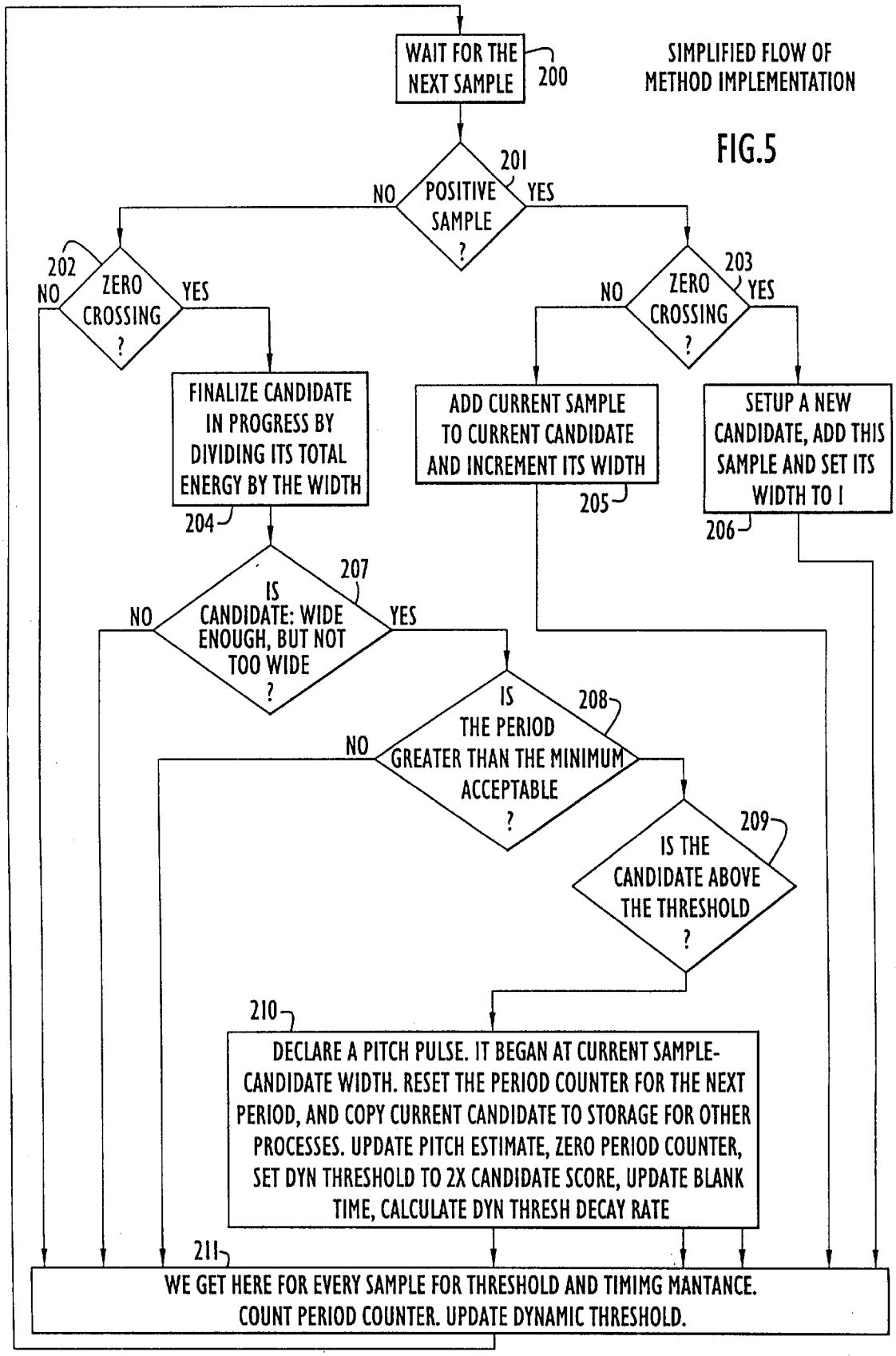
WAIT FOR THE NEXT SAMPLE
200
SIMPLIFIED FLOW OF METHOD IMPLEMENTATION
FIG.5
POSITIVE SAMPLE ?
201
NO
YES
ZERO CROSSING ?
202
NO
YES
ZERO CROSSING ?
203
NO
YES
FINALIZE CANDIDATE IN PROGRESS BY DIVIDING ITS TOTAL ENERGY BY THE WIDTH
204
ADD CURRENT SAMPLE TO CURRENT CANDIDATE AND INCREMENT ITS WIDTH
205
SETUP A NEW CANDIDATE, ADD THIS SAMPLE AND SET ITS WIDTH TO 1
206
IS CANDIDATE: WIDE ENOUGH, BUT NOT TOO WIDE ?
207
NO
YES
IS THE PERIOD GREATER THAN THE MINIMUM ACCEPTABLE ?
208
NO
IS THE CANDIDATE ABOVE THE THRESHOLD ?
209
210
DECLARE A PITCH PULSE. IT BEGAN AT CURRENT SAMPLE-CANDIDATE WIDTH. RESET THE PERIOD COUNTER FOR THE NEXT PERIOD, AND COPY CURRENT CANDIDATE TO STORAGE FOR OTHER PROCESSES. UPDATE PITCH ESTIMATE, ZERO PERIOD COUNTER, SET DYN THRESHOLD TO 2X CANDIDATE SCORE, UPDATE BLANK TIME, CALCULATE DYN THRESH DECAY RATE
211
WE GET HERE FOR EVERY SAMPLE FOR THRESHOLD AND TIMIMG MANTANCE. COUNT PERIOD COUNTER. UPDATE DYNAMIC THRESHOLD.

INSTANTANEOUS DETECTION OF HUMAN SPEECH PITCH PULSES

This is a continuation of U.S. provisional application Ser. No. 60/066,880, filed Nov. 25, 1997.

BACKGROUND OF THE INVENTION

1. Field of the Invention

The present invention relates to a method for nearly instantaneous detection of human speech pitch pulses, for use with pitch tracking processes, an important part of speech coding.

2. Discussion of the Related Art

Speech coding is used in a number of areas of voice signal processing and has many applications. In one important application, spoken language analog wave forms are sampled, digitized and processed, using speech bandwidth compression algorithms, to render compressed digitized versions of the spoken language waveforms for subsequent storage or transmission; such processing is called voice coding (or vocoding). Voice or spoken word signal analysis and bandwidth compression processes find application in digital transmission processes, such as those required for telephonic communication over a low bandwidth data channel such as the Internet, or for use in instruments used by the hearing impaired.

There is a class of sensory aids having tactile sense stimulators to be worn on the body (e.g., on the wrist), for use by deaf persons; the sensory aids are designed to provide deaf persons with access, via the sense of touch, to the acoustic waveform of speech. Intonation patterns in speech, i.e., the patterns and variation in the fundamental frequency of the voice over time, play several roles. For example, the intonation patterns help define where sentences begin and end, they mark the more important words in a sentence, and they sometimes serve to differentiate questions from statements. A wearable tactile sensory aid allows a lip reading deaf individual to lip read with greater accuracy and improves the quality and intelligibility of self generated speech responses. As an example, U.S. Pat. No. 4,581,491 issued to Arthur Boothroyd, discloses a wearable tactile sensory aid for providing information on voice pitch and intonation patterns; the entire disclosure of U.S. Pat. No. 4,581,491 is incorporated herein, in its entirety, by reference.

One problem encountered in use of the wearable tactile sensory aids of the prior art is a time lag associated with analyzing and encoding the voice pitch and intonation pattern information (within the sensory aid) and communicating voice pitch and intonation information to the wearer through an output stimulator/transducer. More particularly, there is an excessive time lag between the time an input transducer converts the spoken voice signal into an analog electrical waveform and the time at which the output transducer communicates the voice pitch and intonation pattern information to the wearer. The excessive time lag confuses the deaf wearer because some memory of what the wearer has just seen (while lip reading) must be maintained over the duration of the time lag. The tactile sensory aid (or vibrotactile aid) transmits, via an output transducer, an acoustical or vibratory signal having selected characteristics. Vibrotactile vocoders have also been used and include a bank of bandpass filters having outputs to modulate a carrier pulse transmitted using the output transducers. Perception of vibrotactile patterns is an ongoing area of research and, unfortunately, the vocoder concept requires perception of differential amplitude levels of individual stimulators in an output transducer array, but array spacing presents problems which have yet to be solved.

Turning to the more general problem, in speech analyzing systems, information must be derived from spoken language by deriving the frequency of energy in a speech formant, i.e., the frequency of a formant arising in response to a larynx excitation. Each time the larynx excites the vocal tract, the tract produces a set of exponentially damped sinusoidal waves. The exponentially damped sinusoidal wave form occurs for voiced utterances and includes frequency components generally in three ranges for formants. The ranges for the average male are 200 to 1000 hertz, 800 to 2300 hertz, and 2300 to 3800 hertz. Each time the larynx is re-excited, the previous set of sinusoidal waves is usually completely damped because the Q of the previously existing resonant cavity drops virtually to 0 in response to opening of the glottis. Thus, there is virtually no phase interference between waves deriving from adjacent larynx excitations and the damped sinusoids are easily identified by filters segmenting the frequency ranges occupied by the formants. The periods of formants have thus been an area of interest in speech analyzing systems. For example, U.S. Pat. No. 3,335,225 to Campanella and Coulter, the entire disclosure of which is incorporated herein by reference, discloses a circuit and method for tracking formant periods. By measuring the period of the damped sinusoid following each larynx excitation in the formant of interest, formant frequencies are ascertained. The period is inversely proportional to the formant frequency and can be measured as a function of the time it takes a predetermined number of half cycles of the damped sinusoid to be completed. The length of each half cycle is measured as a function of the time duration between adjacent zero reference crossings. Thus, in order to accurately measure formant period from the waveform, the first peak of the decaying exponential sinusoid must be accurately detected, and so a pitch pulse (i.e., a pulse indicating the beginning of a new waveform period) must be detected.

Prior art methods for detecting the pitch pulse have required excessive time. Acoustical signal processing circuitry is usually executed in the digital domain, wherein an analog voice waveform periodically sampled at a rate high enough to capture the spectrum of interest (e.g. 10 kHz), the sample values are quantized or converted to digital values and a digital representation of a voice waveform over a selected time interval is stored for later analysis and pitch pulse detection. Digital signal processing algorithms are used in processing the stored or buffered digital representation (for detecting pitch pulses and completing the speech waveform analysis) and may take a significant amount of time to complete, usually many pitch periods, thereby generating the unacceptable excessive time lag, as discussed above. Many uses of speech coding are hampered, in current practice, by having to have future data samples, or a large buffer of data, and produce only an average indication of pitch rate (e.g., throwing away useful information if natural-sounding reconstruction is desired). Additionally, requiring a large amount of data to be available to track pitch means that buffer based algorithms cannot function in real time, without considerable delay in producing an output. For many years, an oft-repeated lament in the field of speech signal analysis has been if one could only track formants one could track pitch, or vice-versa. The reason for this is that formants can change significantly on a pitch period by period basis, and any technique that attempts to track them by analyzing several pitch periods as a group incurs two unpleasant problems. One is time-smearing of the actual formant information, which was changing during the analysis interval. The other is called "pitch ripple" where components of the pitch period and it's harmonics pollute the formant information.

Accordingly, there has been a long felt need for a method for detecting human speech pitch pulses on a nearly instantaneous basis. To be practicable and economically feasible, the desired method should require a minimum amount of computational resources and allow the subsequent speech coding and decoding processes to be accomplished in an efficient manner.

SUMMARY OF THE INVENTION

Accordingly, it is a primary object of the present invention to overcome the above-mentioned difficulties by providing a method for nearly instantaneous detection of human speech pitch pulses.

Another object of the present invention is providing an efficient and effective method for detecting pitch pulses and thereby allowing speech coding and decoding to be performed in an efficient, effective manner and with a minimum of time lag.

Another object of the present invention is overcoming problems of time-smearing and pitch ripple by allowing analysis over a single, accurately determined pitch period.

Yet another object of the present invention is to provide a method for use in speech coding and decoding and permitting a vibrotactile aid to function with a minimum of time lag, thereby allowing easier lip reading by deaf users.

The aforesaid objects are achieved individually and in combination, and it is not intended that the present invention be construed as requiring two or more of the objects to be combined unless expressly required by the claims attached hereto, since it involves a fundamentally new insight with wide applicability in many areas, including analysis of any phenomena produced by the impulse-filter model.

In accordance with the method of the present invention, pitch is tracked for a selected source process characterized by a pitch source having many harmonics followed by a bandpass filtering (e.g., human speech or other common processes). The filtering in the original source process causes an original pitch pulse to be seen in somewhat modified form and followed by ringing at band pass filter frequencies. Often, the ringing produces peaks of unpredictable amplitude, a characteristic making it difficult to use simplistic methods such as picking waveform amplitude peaks. The method of the present invention avoids such difficulties by taking into account relative phase of harmonics associated with the basic pitch rate or frequency (F0). Since the bandpass filters in the original process ring at frequencies present in the excitation other than the fundamental excitation frequency and these frequencies are not necessarily harmonically related to the fundamental frequency, the instantaneous phase of each of the ringing frequencies are only temporally aligned or lined up well for the duration of the original pitch pulse (i.e., the pitch pulse sinusoidal half cycle) whereas for later ringing-created peaks, this phase alignment is not observed. A computational trap door or efficient algorithm has been developed to check for the phase aligned case and is part of the method of the present invention. The algorithm essentially looks for squareness in a candidate pulse (i.e., a positive sinusoidal half cycle which may or may not be a pitch pulse, as defined above), thereby indicating that at least all of the odd order harmonics are substantially in phase with the fundamental pitch (F0). Even order harmonics of candidate pulses are effectively ignored using the method of the present invention, but the odd harmonics alone are sufficient to produce a metric for indicating pitch pulses more robustly than methods relying on mere peak picking can do.

The algorithm for this part of the method of the present invention includes the following method steps:

An analog waveform is sampled and the sample amplitudes are then quantized or digitized to produce a digital source signal. A computer with a software program or algorithm is used to process the digital source signal. The algorithm identifies the boundaries of each candidate pulse (i.e., all of the periodic samples that lie between a first and second zero crossings of the plotted digital source signal), a pulse width is measured from the first zero crossing to the second zero crossing, to generate a candidate width (i.e. duration). A convolution step is performed, in which a square pulse of the same candidate width is convolved with the candidate pulse sample amplitude values; next, the result is normalized to the candidate width. To accomplish the convolution and normalization steps, the plurality of (periodic and discrete) amplitude samples are added and the resulting sum is divided by the number of samples (i.e. by the duration) of the candidate width, to generate a candidate score. The method becomes more accurate as the sample rate is increased, either by sampling the analog signal at a higher rate or by interpolating the digital signal to a higher rate, since what is being accomplished is a discrete integration of the energy under the pulse, and the smaller the delta, the more accurate this discrete approximation of a continuous integral becomes.

The candidate score is a value that can be peak picked far more robustly than with amplitude peak picking alone, since the candidate score of each candidate pulse now contains information about whether the odd harmonics were in phase (if not in phase, the candidate score will be less than if in phase, making the actual pitch pulses stand out more in the resulting candidate score data). A major advantage of this method is that the information becomes available quickly at the end of each candidate pitch pulse, in real time.

The results of this method can then be used to perform candidate score peak picking; the information generated by the first part of the process consists of pulse candidate values, start times, and candidate widths. Since some non-pitch pulse candidates are produced, (one per positive zero crossing) the goal is to eliminate from consideration all candidate pulses that are not really pitch pulses.

The first and simplest defense mechanism is to compare the candidate widths (i.e., durations) of each candidate pulse against some practical limits for speech signals. For example, if a candidate pulse is too wide (e.g., >7 milliseconds (ms)) and therefore cannot be produced by a human vocal tract, it is rejected; similarly, if a candidate pulse is too narrow (e.g., <0.5 ms), thereby indicating unpitched high frequency content, it is also rejected. Similar defense mechanisms are applied to the pulse repetition rate of candidate pulses, as well; if the rate is too high (e.g., 500 Hz for adults) or too low, the waveform is not human pitch. Defense mechanisms such as these can be used to set adjustable width thresholds and the thresholds can be set on a dynamic basis, according to the expected and previous signals received.

Once a candidate has passed the defensive mechanism tests, the candidate pulse is compared to a candidate score threshold for the peak picking part of the process. Setting the candidate score peak picking threshold correctly for a given case is central to the method. For the first candidate pulse, the candidate score threshold is automatically set to the candidate score, and the first candidate pulse is declared to be a pitch pulse. If the second candidate pulse has a candidate score higher than the candidate score threshold, a hit is declared, the candidate score threshold is automatically set to the higher candidate score, and the second candidate pulse is declared to be a pitch pulse. Thus, whenever a candidate is declared to be an actual pitch pulse, the threshold used for candidate score peak picking is set to the candidates level. A variable is kept which indicates the expected average pitch. For a blanking interval or period equal to slightly longer than 50% of the average pitch variable value, the candidate score threshold is not modified. If a hit occurs during the first half of the blanking interval, e.g. 25% of the expected period, and its amplitude is greater than a prior hit, it is assumed that the prior hit was spurious and the new hit is declared an actual pitch pulse. After the blanking interval, the amplitude threshold begins to be bled, in a decaying exponential fashion, at such a rate to produce a threshold of approximately 65% of the original candidate amplitude at the time of the next expected pitch pulse. After this time, the threshold continues to bleed down, but at a much lower rate of decay (to accommodate switching between speakers of different loudness, etc.) but still provides some defense against likely background noise. The 65% threshold allows the method to track rapidly lowering amplitude speech sounds, for instance, while staying high enough to limit spurious hits. The blanking interval is set to prevent pitch doubling, a common problem with all pitch tracking algorithms. Use of a large hit inside this interval to re-synchronize or adjust the hit threshold is a unique characteristic of the method of the present invention. As hits come out of the front end pitch pulse identifying process, as discussed above, the hits are converted to periods by subtracting the time of the current hit from the time of the previous hit. The periods are used to generate an instantaneous estimate of the pitched rate. The instantaneous estimate of the pitch rate still likely has a few errors, however, but the number of errors is reduced further by averaging a selected number (e.g., 4) and then using low pass filtering to produce an estimate for controlling front end blanking and threshold decay rates. It should be noted that although this interval variable is averaged, what comes out of the front end process is not, and so each hit is a completely accurate reflection of the length of the current pitch period. This information is available from the front-end algorithm on a pitch pulse by pulse basis, before the next zero crossing.

Once a pitch pulse has been identified, speech pitch (F0) can be sampled during the pitch pulse duration, for pitch tracking. With a more accurate input indication of pitch (F0), some rather simple error defense algorithms can be used to produce a nearly perfect tracking of pitch (F0) on a pitch-pulse by pitch-pulse basis. Using the method of the present invention, one can track pitch on a pulse-by-pulse basis, accurately enabling pitch synchronous harmonic analysis and making formant tracking straightforward (using, e.g., the method of U.S. Pat. No. 3,335,225). This result enables a large new class of applications for vocoding, the Internet phone for instance; such new devices can operate much closer to real time than existing (e.g., military) vocoders, and also can have better voice quality at low bit rates than is currently possible using existing technology.

Since the data is available on an instantaneous basis, the other analysis needed for vocoding etc. can also be more accurate and timely than with current methods. Current methods use averaging to help them avoid large errors, which is not needed when using this front end, and also to reduce the amount of data which is sent across the channel. However, the possession of accurate and instantaneous data suggests another approach.

In tactile stimulators for use by the deaf, once a candidate pulse has been confirmed as a pitch pulse, it may be immediately be output to the stimulator on the wrist. In prototypes developed thus far, only every other pitch pulse is presented for tactile stimulus, in order to reduce the pulse repetition rate to a range which has been shown to be maximally useful to the skin; the reduced repetition rate is well suited to allow the skin to discern differences in repetition rate associated with the standard pitch frequencies (e.g., about 60–330 Hz). Thus, the presentation rate currently used is in the range of 30–165 Hz. Also, the actual pulse (whose width varies with the frequency represented by the 2 cycle of the first pulse) is not currently presented; instead, a pulse of about 1–2 ms width is presented, and the shape used is generally similar to a Haversine or raised cosine pulse.

Since it may be difficult to identify the very first pulse as a bona-fide pitch pulse, and the consequences of error may be distracting to the lip reading subject, at present the second pulse is presented, and then every other pulse from then on. In return for this more accurate tracking there is a tradeoff of a one pulse delay; in the future, there may be methods devised to start with the first pulse rather than the second. Also, methods may be found to combine formant information with instantaneous pitch information to increase the usefulness of the tactile device to the deaf user while lip reading.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

BRIEF DESCRIPTION OF THE DRAWINGS

FIG. 5 is another procedural flow chart illustrating a second example of the manner in which the method for identifying pitch pulses for tracking pitch is performed, in accordance with the present invention.

DETAILED DESCRIPTION OF THE PREFERRED EMBODIMENTS

Figure 1:
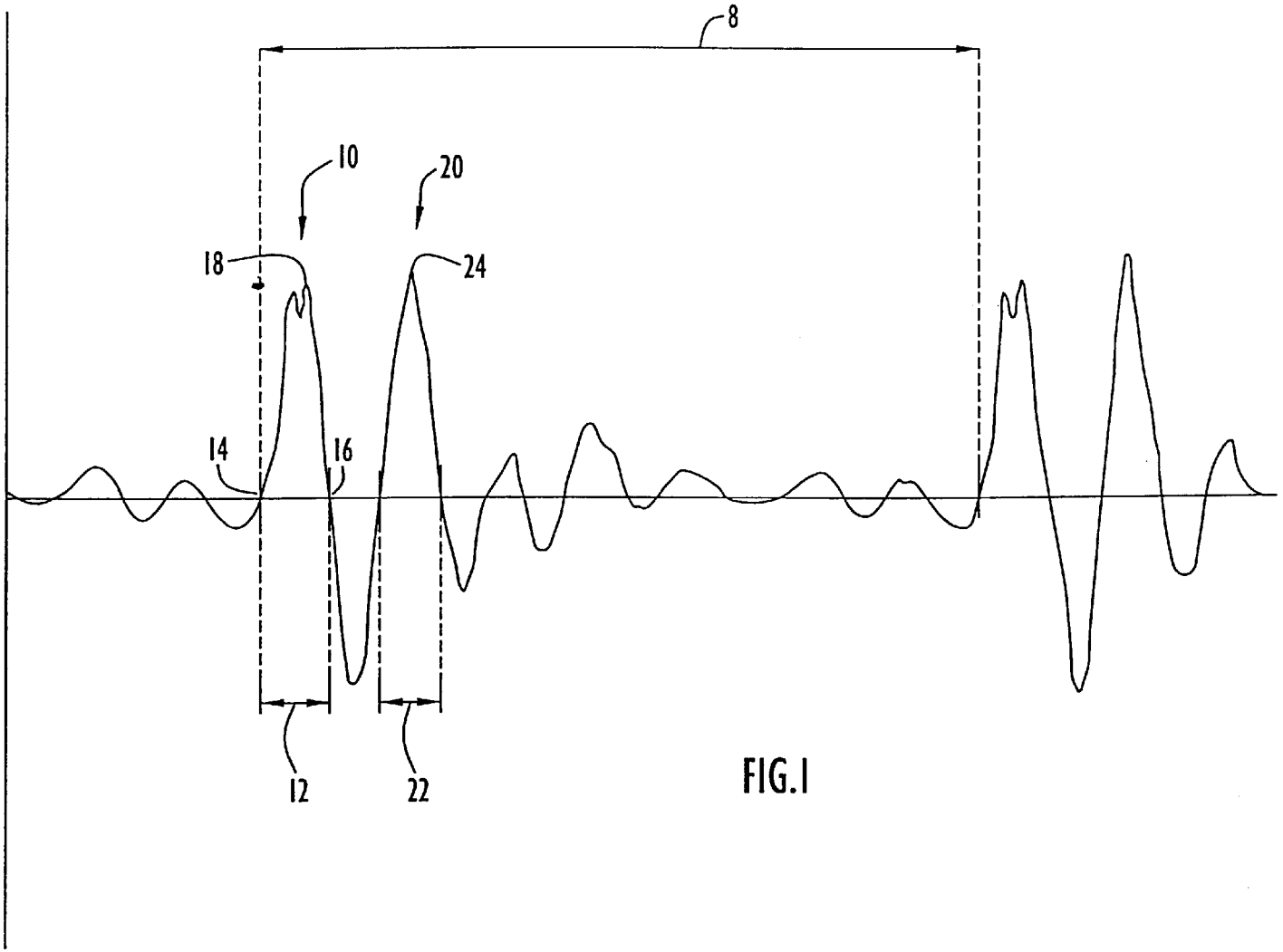
FIG. 1 is an exemplary storage oscilloscope trace of a speech waveform of the vowel sound "ah".

The method of the present invention includes the following steps:

First, an analog waveform is sampled at a selected periodic sampling rate. An exemplary waveform is shown in FIG. 1, illustrating a storage oscilloscope trace of a speech waveform corresponding to the vowel sound ah, at a pitch fundamental frequency of 130 Hz. The waveform illustrates slightly more than one pitch period, where a pitch period is defined as the interval beginning with the leading edge of a pitch pulse (e.g., leading edge 14 of first pulse 10) and ending just before the leading edge of a successive pitch pulse. For purposes of this illustrative example, interval 8 is a pitch period having a duration of approximately 7.6 ms. In the next step, sample amplitudes are quantized or digitized to produce a digital source signal. A computer with a software program or front end algorithm is used to process the digital source signal. The algorithm identifies the boundaries of a candidate pulse (e.g., all of the samples that lie between first and second zero crossings) such as first pulse 10, a pulse width 12 is measured from the first zero crossing 14 to the second zero crossing 16, to generate a candidate width (e.g., duration of pulse width 12). A convolution step is performed, in which a square pulse of the same candidate width is convolved with the candidate pulse sample amplitude values; next, the result is normalized to the candidate width. To accomplish the convolution and normalization steps, the plurality of (periodic and discrete) sample amplitude values are added and the resulting sum is divided by the number of samples (e.g., by the number of samples falling within the duration of pulse width 12) of the candidate width, to generate a candidate score.

Table one illustrates the results of the method steps for first pulse 10. It is to be understood that in the present hypothetical example, six samples were taken within the pulse width corresponding to interval 12. For first pulse 10, note that the pulse top appears to be wider and include a small amplitude ringing; also, the pulse amplitude peak 18 is measured in sample 5.

TABLE 1

| SAMPLE | VALUE | SUM | CANDIDATE SCORE |
|---|---|---|---|
| 1 | 0.0 | — | — |
| 2 | 7.0 | — | — |
| 3 | 11.0 | — | — |
| 4 | 13.5 | — | — |
| 5 (peak) | 14.0 | — | — |
| 6 | 0.0 | 45.5 | (45.5/6) = 7.58 |

Table two illustrates the results of the method steps for second pulse 20. Six samples were taken within the pulse width corresponding to interval 22. For second pulse 20, note that the pulse top appears to be narrow and includes no apparent ringing; also, the pulse amplitude peak 24 is measured in sample 3.

TABLE 2

| SAMPLE | VALUE | SUM | CANDIDATE SCORE |
|---|---|---|---|
| 1 | 0.0 | — | — |
| 2 | 10.0 | — | — |
| 3 (peak) | 15.8 | — | — |
| 4 | 8.0 | — | — |
| 5 | 3.0 | — | — |
| 6 | 0.0 | 36.8 | (36.8/6) = 6.13 |

Figure 2:
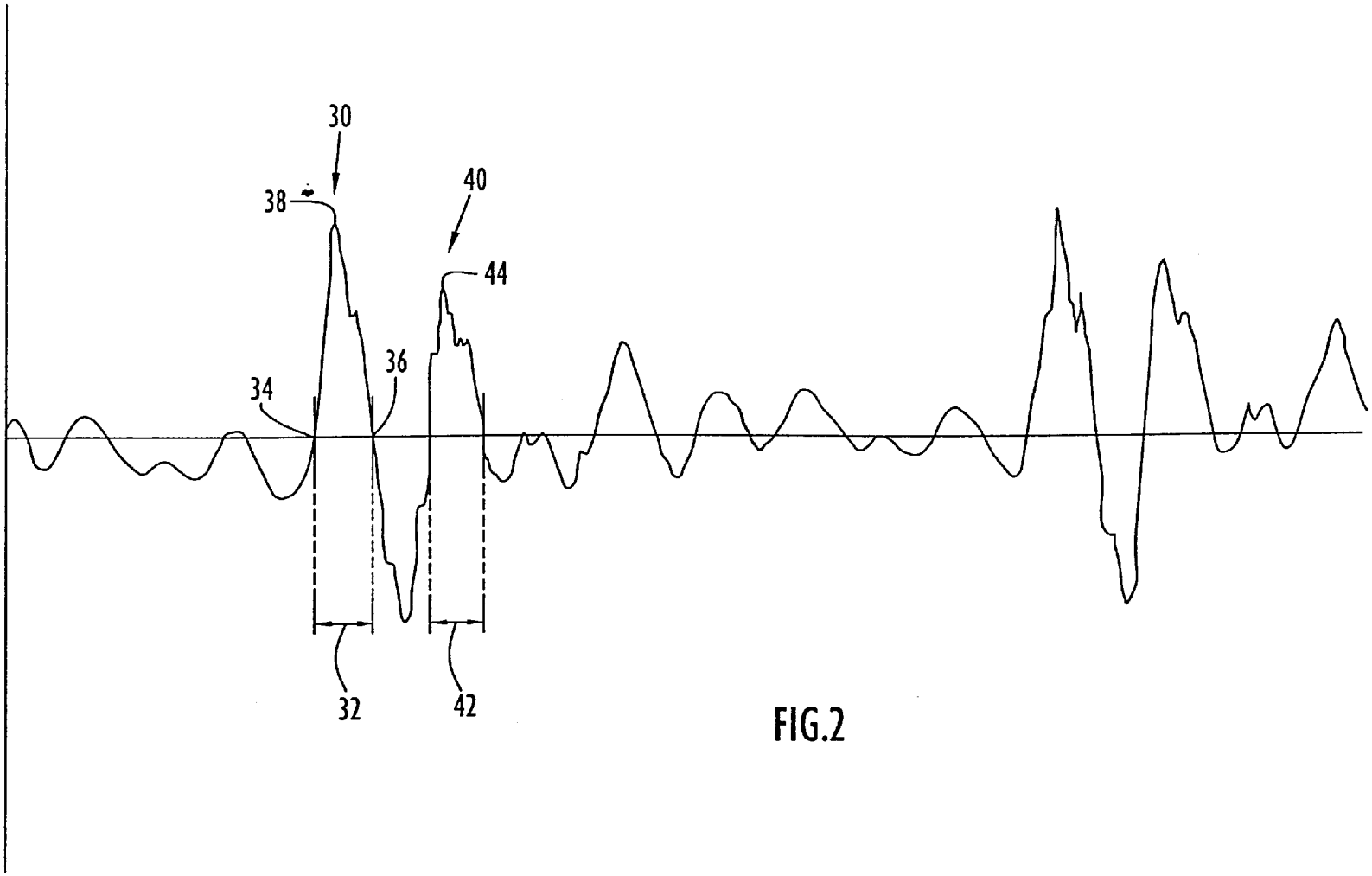
FIG. 2 is an exemplary storage oscilloscope trace of a speech waveform of the vowel sound "aw".

A second exemplary waveform is shown in FIG. 2, illustrating a storage oscilloscope trace of a speech waveform corresponding to the vowel sound aw, as in law. For the waveform of FIG. 2 five samples were taken for each candidate pulse and sample amplitudes were then quantized or digitized to produce a digital source signal. The algorithm identifies the boundaries of each candidate pulse (i.e., all of the periodic samples that lie between a first and second zero crossings of the plotted digital source signal) such as third pulse 30. Pulse width 32 is measured from the first zero crossing 34 to the second zero crossing 36, to generate a candidate width (e.g., duration 32). As before, a convolution step is performed, in which a square pulse of the same candidate width is convolved with the candidate pulse sample amplitude values; next, the result is normalized to the candidate width.

Table three illustrates the results of the method steps for third pulse 30. The five samples were taken within the pulse width corresponding to interval 32. For third pulse 30, note that the pulse top appears narrow; also, the pulse amplitude peak 38 is measured in sample 3.

TABLE 3

| SAMPLE | VALUE | SUM | CANDIDATE SCORE |
|---|---|---|---|
| 1 | 0.0 | — | — |
| 2 | 7.0 | — | — |
| 3 (peak) | 14.0 | — | — |
| 4 | 6.5 | — | — |
| 5 | 0.0 | 27.5 | (27.5/5) = 5.5 |

Table four illustrates the results of the method steps for fourth pulse 40. The five samples were taken within the pulse width corresponding to interval 42. For fourth pulse 40, note that the pulse top appears to be narrow but includes some ringing; also, the pulse amplitude peak 44 is measured in sample 2.

TABLE 4

| SAMPLE | VALUE | SUM | CANDIDATE SCORE |
|---|---|---|---|
| 1 | 0.0 | — | — |
| 2 (peak) | 8.5 | — | — |
| 3 | 7.5 | — | — |
| 4 | 6.0 | — | — |
| 5 | 0.0 | 22.0 | (22.0/5) = 4.4 |

Thus, for first pulse 10 of the ah waveform of FIG. 1, the amplitude peak is 14 units (e.g., millivolts) and the candidate score is 7.58, whereas for second pulse 20, the amplitude peak is greater at 15.8 units and the candidate score is lower at 6.13. Thus, first pulse 10 has a greater candidate score than the higher amplitude second pulse 20, and is correctly selected as the pitch pulse. This example illustrates that the front end algorithm of the method of the present invention will reliably identify pitch pulses, even when a non-pitch pulse of greater amplitude is found within the pitch period.

The candidate score metric is analogous to measuring the squareness or area of a candidate pulse, where greater squareness or area yields higher candidate scores. In the ah waveform of FIG. 1, the peak amplitude of first pulse 10 is 88% of the peak amplitude of second pulse 20, but the candidate score is 23% higher, and so provides a reliable indicator for choosing the pitch pulse from among the candidates.

For third pulse 30 of the aw waveform of FIG. 2, the amplitude peak is 14 units and the candidate score is 5.5, whereas for fourth pulse 40, the amplitude peak is lower, at 8.5 units, and the candidate score is also lower at 4.4. Thus, third pulse 30 has a greater candidate score than the lower amplitude fourth pulse 40 and is correctly selected as the pitch pulse. This illustrates that the algorithm will also reliably identify pitch pulses when a non-pitch pulse of lower amplitude is found within the pitch period. In the aw waveform of FIG. 2, the peak amplitude of third pulse 30 is 64% higher than the peak amplitude of fourth pulse 40, and the candidate score is 25% higher, and so is a reliable metric for choosing the pitch pulse, whether the pitch pulse has a higher or lower amplitude than a non-pitch pulse found within the pitch period.

The candidate score is a value that can be peak picked far more robustly than with amplitude peak picking alone, since the candidate score of each candidate pulse now contains information about whether the odd harmonics were in phase (if not in phase, the candidate score will be less than if in phase, making the actual pitch pulses stand out more in the resulting candidate score data). A major advantage of using the front end algorithm method is that the information becomes available quickly at the end of each candidate pitch pulse, in real time.

The results of the algorithm are used to perform candidate score peak picking; the information generated by the first part of the process consists of pulse candidate scores, start times, and candidate widths. Since some non-pitch pulse candidates are produced, (at most one per positive zero crossing) the goal is to eliminate from consideration all candidate pulses that are not really pitch pulses.

The first defense mechanism is to compare the candidate widths (i.e., durations) of each candidate pulse against some practical limits for speech signals. For example, if a candidate pulse is too wide (e.g., >17 milliseconds (ms)) and therefore cannot be produced by a human vocal tract, it is rejected; similarly, if a candidate pulse is too narrow (e.g., <3 ms), thereby indicating unpitched high frequency content, it is also rejected. Similar defense mechanisms are applied to the pulse repetition rate of candidate pulses, as well; if the rate is too high or too low, the waveform is not human pitch. Defense mechanisms such as these can be used to set adjustable width thresholds and the thresholds can be set on a dynamic basis, according to the expected and previous signals received. For example, the adjustable width thresholds can be dynamically adjusted over a preselected range which, over a period of 100 ms (e.g., an interval including six to fourteen actual pitch pulses), allows width thresholds to vary only by a factor of two. Thus, over a period of 100 ms, the minimum pulse width can be dynamically varied to as little as 1.5 ms or as much as 6 ms and over the same 100 ms period, the maximum pulse width can be dynamically varied to as little as 8.5 ms or as much as 34 ms, respectively.

Once a candidate pulse has passed the defensive mechanism tests, the candidate score of the pulse is compared to a candidate score threshold for the candidate score peak picking part of the process. Setting the candidate score peak picking threshold correctly for a given case is central to the method. For the first candidate pulse (e.g., first pulse 10), the candidate score threshold is automatically set to the candidate score (e.g., 7.58), and the first candidate pulse is declared to be a pitch pulse. If the second candidate pulse has a candidate score higher than the candidate score threshold, the candidate score threshold is automatically set to the higher candidate score, and the second candidate pulse is declared to be a pitch pulse; (in the waveform of FIG. 1, second pulse 20 actually has a lower candidate score, 6.13, and so is not declared a pitch pulse.)

Thus, whenever a candidate pulse is declared to be an actual pitch pulse, the threshold used for candidate score peak picking is set to the most recent pitch pulses candidate score level. In the algorithm, a variable is kept which indicates the expected average pitch (e.g., 130 Hz, as in the waveform of FIG. 1). For a blanking interval or period equal to slightly longer than 50% of the average pitch period variable, the candidate score threshold is not modified. If a hit (i.e., selection of a candidate pulse as a pitch pulse) occurs during the first half of the blanking interval, e.g. 25% of the expected period, and its candidate score is greater than that of a previous, threshold-setting hit, it is assumed the previous hit was a misfire and re-synchronizes to the new hit as the actual pitch pulse. After the blanking interval, the hit threshold begins to be bled in a decaying exponential fashion at such a rate to produce a threshold of approximately 65% of the original candidate score at the time of the next expected pitch pulse. After this time, the threshold continues to bleed down, but at a much lower rate of decay (to accommodate switching between speakers of different loudness, etc.) but still provides some defense against likely background noise. The 65% threshold allows the method to track rapidly lowering amplitude speech sounds, for instance, while staying high enough to limit spurious hits. The blanking interval is set to prevent pitch doubling, a common problem with all pitch tracking algorithms. Use of a large candidate score hit inside this interval to re-synchronize the threshold is a unique characteristic of the method of the present invention. As hits come out of the front end pitch pulse identifying process, as discussed above, the hits are converted to periods by subtracting the time of the current hit from the time of the previous hit. The periods are used to generate an instantaneous estimate of the pitched rate. The instantaneous estimate of the pitch rate still likely has a few errors, however, but the number of errors is reduced further by averaging a selected number (e.g. 4) and then using low pass filtering to produce an estimate for controlling front end blanking and threshold decay rates. It should be noted that although this interval variable is averaged, what comes out of the front end process is not, and so each hit is a completely accurate reflection of the length of the current pitch period, including fine detail usable to regenerate speaker pitch jitter, or diplophonia at a later time.

This information is available from the front-end (the method) on a pitch pulse by pulse basis, before the next zero crossing, which means that applications that are used to perform pitch-synchronous analysis need store no past or future data, allowing them to have immediate response to speaker input, unlike current schemes which incur a delay of many pitch periods and which also average out information that would be useful in natural-sounding speech reconstruction at the other end of a communications channel.

Figure 3A:
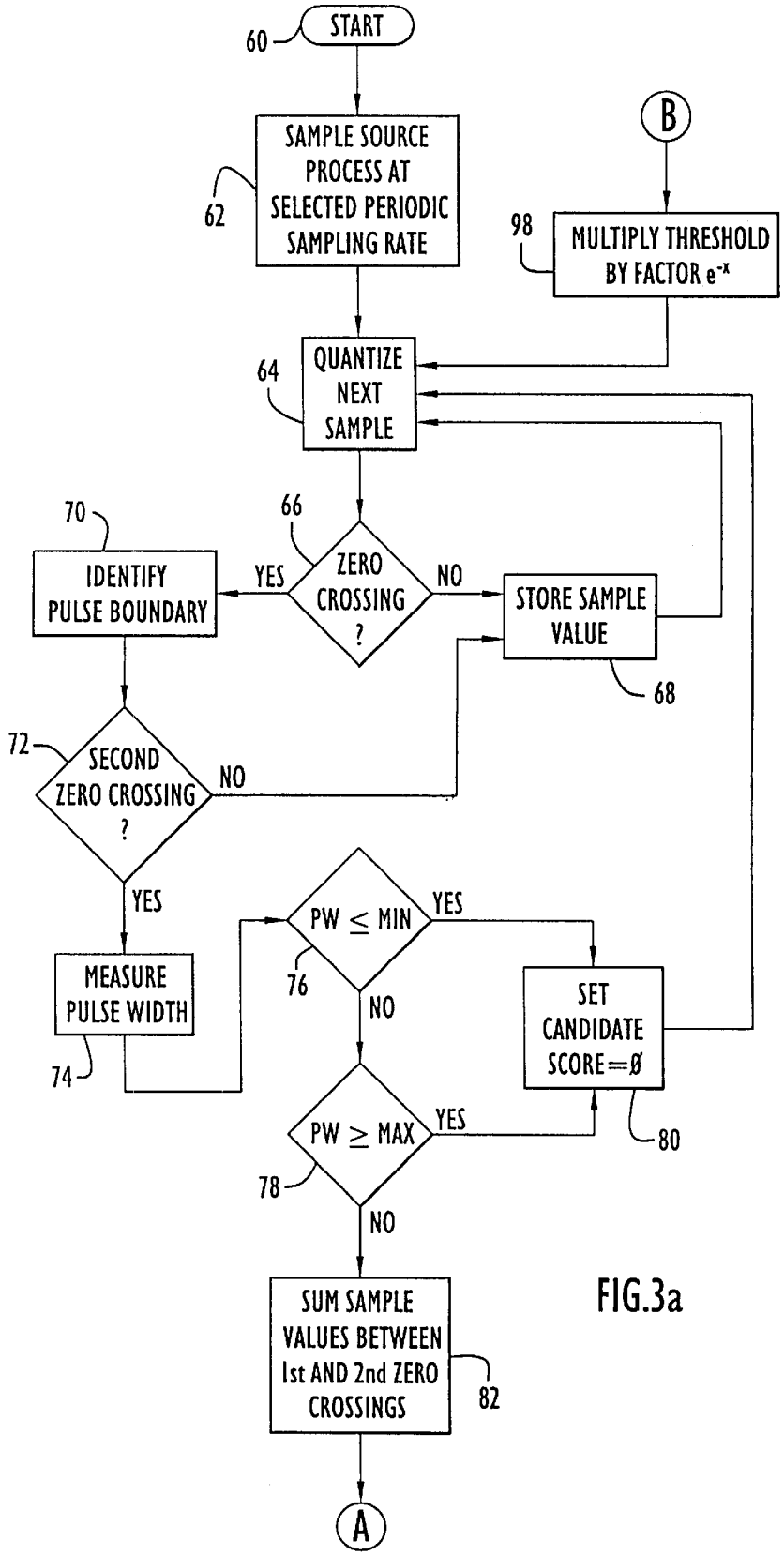
FIGS. 3*a* and 3*b* are a procedural flow chart illustrating one example of the manner in which the method for identifying pitch pulses for tracking pitch is performed, in accordance with the present invention.
Figure 3B:
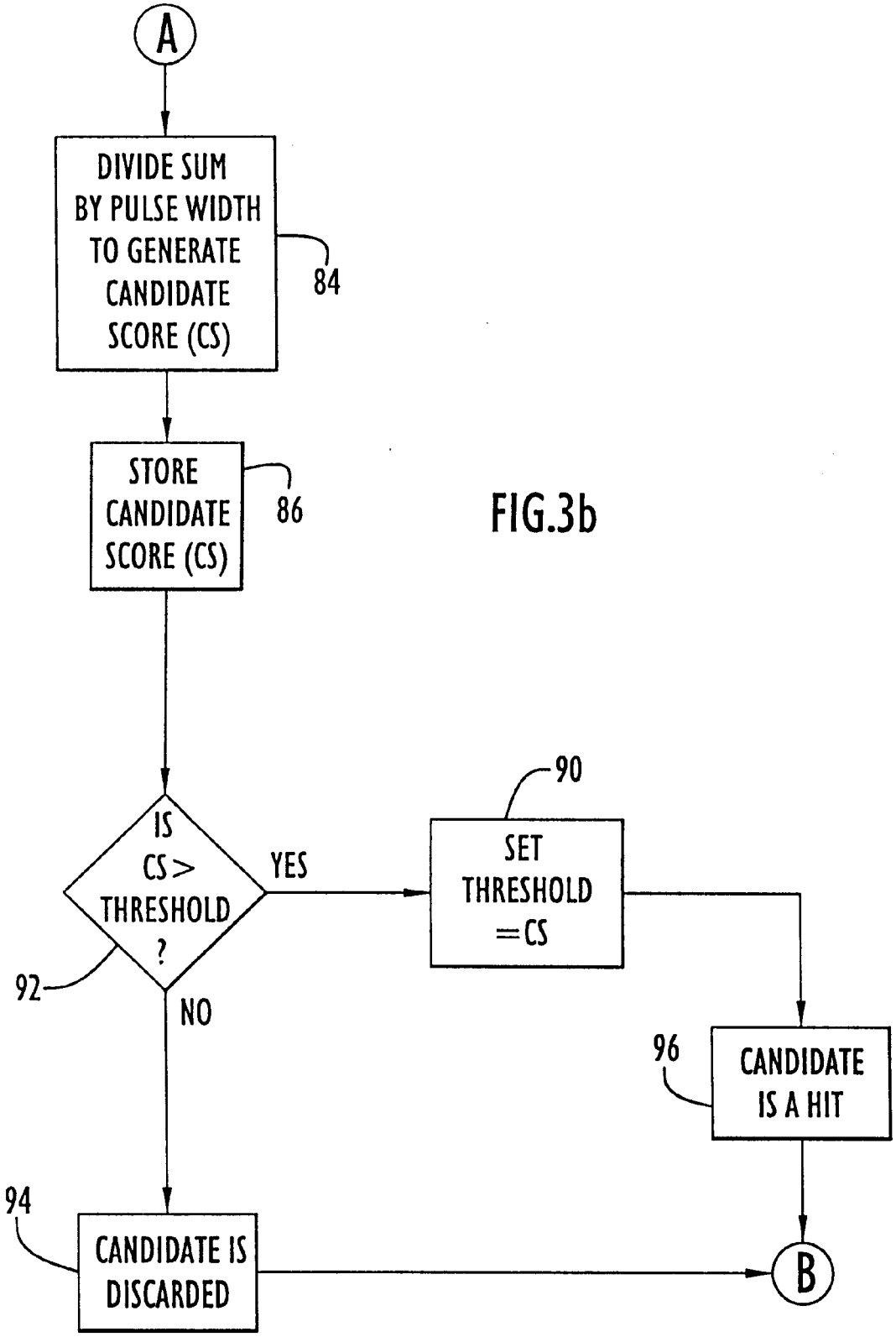

FIGS. 3*a* and 3*b* together comprise a procedural flow chart illustrating one example of the manner in which the method for identifying pitch pulses for tracking pitch is performed in accordance with the present invention. It is to be understood that a person of ordinary skill in the computer programming art can readily prepare algorithms from the flowcharts, drawings and functional description provided herein. A computer program implementing the method and algorithm of the present invention can be coded in assembly language or another computer programming language.

The method for tracking pitch of an analog signal from a selected source process (such as the analog waveform of FIG. 1) includes a number of method steps identified by the referenced flow chart symbols or blocks 60–96. The method begins with steps 60 and 62, sampling the source process analog signal at a selected periodic sampling rate to generate a plurality of source signal samples having amplitude values followed by step 64, quantizing and storing the first (or next) source signal sample to generate a plurality of digitized source signal samples, wherein each digitized source signal sample has a digitized amplitude value. Next, in steps 66, 70 and 72, the boundaries of a first candidate pulse (e.g., pulse 10) are identified by identifying the digitized source signal samples lying between first and second zero crossings (e.g., 14, 16), and in step 74 the first pulse width is measured from the digitized source signal samples lying between the first and second zero crossings to generate a first candidate pulse width (e.g. 12) corresponding to the number of digitized source signal samples lying between the zero crossings. In step 82, the digitized amplitude values for the digitized source signal samples identified as lying between the zero crossings are summed to generate a first candidate pulse digitized amplitude value sum, and in step 84 the first candidate pulse digitized amplitude value sum is divided by the first candidate pulse width (or duration) to generate a first candidate score which is stored in step 86. In step 90, the candidate score threshold is set to the first candidate score and in step 96 it is declared a hit. Looping back to the start of the algorithm and to step 64, the boundaries of a second candidate pulse are identified by identifying the digitized source signal samples lying between third and fourth zero crossings (e.g., of pulse 20), and in step 74, the second pulse width is measured from the digitized source signal samples lying between the third and fourth zero crossings to generate a second candidate pulse width 22 corresponding to the number of digitized source signal samples lying between zero crossings. Continuing with the algorithm, in step 82, the digitized amplitude values for the digitized source signal samples identified as lying between the zero crossings are summed to generate a second candidate pulse digitized amplitude value sum, and in step 84, the second candidate pulse digitized amplitude value sum is divided by the second candidate pulse width to generate a second candidate score which is stored in step 86, along with the results for the previous candidate pulse (or pulses). In steps 90, 92, 94 and 96 the larger of the first candidate score and the second candidate score are compared to identify the larger, which is designated a pitch pulse or hit. In step 90, the candidate score threshold is set to the hit or pitch pulse candidate score.

Optionally, the method further includes steps 76, 78 and 80, in which it is determined whether a candidate pulse width is less than a variable "min" having the value of, for example, 0.5 milliseconds, and generating a candidate score of zero in response to determining the candidate pulse width is less than "min"; preferably, the method also includes determining whether the candidate pulse width is greater than a variable "max" having the value of, for example, seven milliseconds and generating a candidate score of zero in response to determining the second candidate pulse is greater than "max". "Min" and "max" are selected and are optionally dynamically adjusted to omit consideration of pulses having widths not likely to be attributed to human speech, for example. In method step 98, the threshold is adjusted or decreased as an automatic control measure by multiplication with an exponential factor to exponentially bleed down the value of the threshold over time, thus avoiding the case where the algorithm receives a hit with an exceptionally large candidate score and so is subsequently unable to process valid pitch pulses having lower candidate scores.

Figures 4A, 4B, 4C:
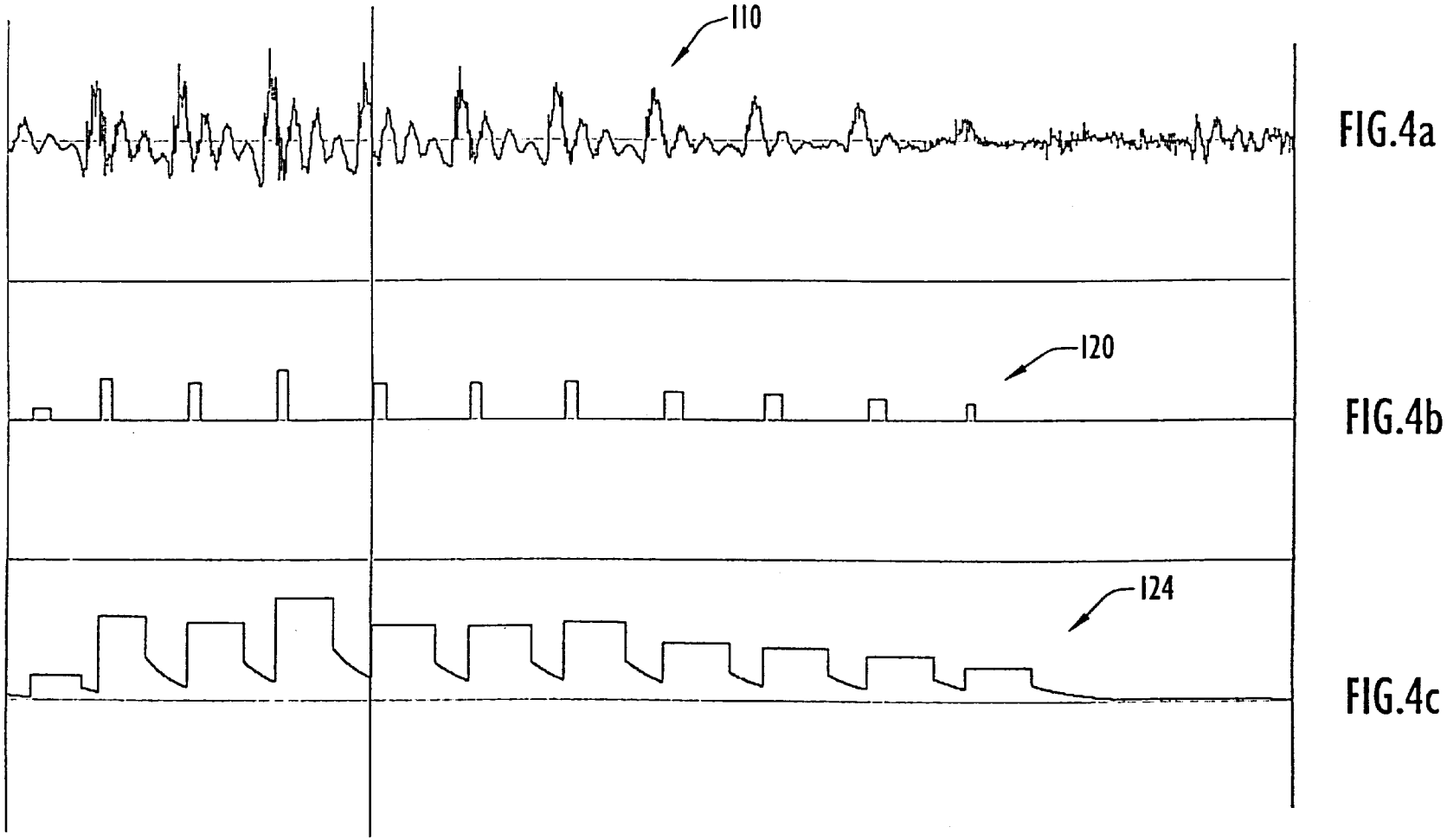
FIG. 4*a* is an exemplary storage oscilloscope trace of a speech waveform of the spoken word "is".
FIG. 4*b* is an exemplary storage oscilloscope trace of a candidate pulse signals for the speech waveform of FIG. 4*a*.
FIG. 4*c* is an exemplary storage oscilloscope trace of dynamic threshold signals for the speech waveform of FIG. 4*a*.

Turning now to another example of the method of the present invention, FIG. 4*a* is an exemplary storage oscilloscope trace of a speech waveform 110 of the spoken word "is"; FIG. 4*b* is an exemplary storage oscilloscope trace of a candidate pulse signals 120 for the speech waveform 110 of FIG. 4*a*; and FIG. 4*c* is an exemplary storage oscilloscope trace of dynamic threshold signals 124 for speech waveform 110. It is assumed for the present discussion that the input signal 110 is in digital form (e.g. has been quantized and sampled at a regular rate such as 8 kHz or above, for speech) and presented to the processor executing the method of the present invention, sample by sample. Fundamental to the process is the detection of zero crossings of the original signal, which is easily accomplished by keeping the value of the previous sample and comparing its sign to the current sample, after which the previous sample variable is updated with the current sample value for next time. In addition, a sequence number is kept which simply counts samples to have a time value available to the rest of the process. The method can work with either polarity of pitch pulses; for this description we will assume that we have chosen to work with positive polarity pulses only. Whenever a positive-going zero crossing is detected, a new candidate is initialized. In software, this is implemented by creating a small structure of data in memory which contains at least: the starting sample number (a sequence number which increases with time), the candidate's total energy, and the candidate's total width in samples. Additional information kept by candidate in most practical implementations includes: the candidate's final normalized score and the time since the previous candidate.

When a new candidate is created, a Boolean flag is set that indicates to the software that a candidate is in progress. The current value of the sequence number is stored in the candidate, it's total energy sum becomes the value of the first positive sample, and it's width is initialized to 1, since this is the first data sample. As successive positive samples come in, they are summed or added to the candidate's total energy (equivalent to convolving the samples in this zero crossing with a square window of amplitude 1.0, but which doesn't require any multiplications). In addition, the width variable is incremented each time to keep track of the length of time this zero crossing lasts. This process continues until a negative going zero-crossing occurs. When a negative zero crossing occurs, the final normalization of the candidate is performed by dividing it's total energy value by it's width to get a measure of it's shape match to the square window that is unaffected by it's width. In the practical implementation this result is also stored in the candidate. The Boolean flag that indicates a candidate is in progress is then cleared, so the software can skip many tests during the samples composing each negative zero crossing and allow more time for other processes to occur. Each completed candidate is then tested in various ways to determine if it actually represents a pitch pulse. First, each is tested for an appropriate width. Too wide a width means that the ringing frequency is too low to be produced by a human mouth, whereas too narrow a width indicates that this candidate was probably produced by high frequency noise. The numbers actually used in the implementation are in the range of 0.5 millisecond for the narrow width limit to approximately 7 milliseconds for the wide limit, although the method can be tuned somewhat to produce better results for male or female speakers (or processes other than speech) by adjusting these numbers somewhat. In addition to the width tests, the candidate is compared to a minimum period which is chosen to limit how high in frequency the method is allowed to track; 2 ms is used in most practical implementations since human pitched speech rarely goes above 500 Hz in adults. If a candidate has passed the simple defensive tests of the present invention, the candidate is preferably then compared to a dynamic threshold to be peak-picked; this method is much more robust than by using peak-amplitude-only information.

Dynamic threshold comparison includes creating a dynamic threshold by one of two possible methods, one of which is better for tactile hearing aids, and the other of which is better for vocoding uses. Significant to this overall method, however, is that these new dynamic threshold creation methods themselves create a better dynamic threshold no matter what the original metric one is trying to peak-pick—our new candidates, or the old peak amplitude metric, both work better when these dynamic thresholds are used, although the new candidate metric is best of all.

In the method which works best for vocoding, the dynamic threshold is constructed sample by sample thusly: Whenever a candidate passes all the above described defensive tests, the dynamic threshold is set to twice (or optionally three times) the score of the candidate to produce a 'blanking' effect. At this time, an internal estimate of the average pitch period is updated as well. As best seen in FIGS. 4*b* and 4*c*, the dynamic threshold remains at twice the previous successful candidate's score (or amplitude) until a blanking interval, chosen to be approximately 55% of the current pitch period estimate expires, when the dynamic threshold is then set to be equal to the candidate's score. After this time, the dynamic threshold is decayed exponentially at a computed rate that will produce a value of approximately 60% of the previous candidate's score at the time the next pitch pulse is expected. If no new candidate passes this threshold during this time, the decay continues at this rate until approximately 1.5 of the expected pitch period passes, at which time the decay is slowed to about 10% per second to prevent quick pickup of noise pulses during speech pauses or unvoiced speech. Thus, the accuracy of the internal estimate of average pitch rate is important, since it is used to set a blanking period duration, a fast-decay rate, and the time a slow decay rate is invoked. The method of ensuring accuracy in this estimate is part of the present method and will be covered shortly. An additional detail must be covered first. Speech and some other signals have the characteristic of occasional sudden fading or dropouts, and most methods are confused by these. If one allows excessively rapid decay of the dynamic threshold to allow these fadeouts to be tracked, one gets many false hits as well. In this method, the dynamic threshold is temporarily dropped to a fraction of it's normal value during a short window of time around the time another pitch pulse is expected, allowing the method to gracefully 'freewheel' through the soft amplitude period without giving false pitch indications, and avoiding false hits as well. This period during which the dynamic threshold is temporarily dipped is ⅙th of the expected pitch period and centered on the time the next pitch pulse is expected. During this time window, the dynamic threshold is dropped to ⅛th of it's normal value, after which it resumes decay following the normal exponential curve and from the value it had at the beginning of the special window.

The estimate of the average pitch period is updated as follows; if the candidate that passes all tests is close to the current estimate, and above the undipped dynamic threshold energy, the estimate is updated to be precisely the previous pitch period on an instantaneous basis with no averaging. If, however, the previous period was a long unvoiced period, it's value is ignored. If the current candidate was picked up due to the dipped dynamic threshold, then the current estimate is updated by averaging a 70% weighting of itself with a 30% weighting of the current candidate's indicated period. This allows some tracking, but keeps large errors from making the estimate inaccurate over long periods of time, which in turn improves the overall accuracy of the method. When a candidate passes all tests, a variable which counts the samples since the previous successful candidate is zeroed, and subsequently counted up with each new digital sample, providing internal timekeeping for use by the blanking algorithm, and other portions of the method that need this.

In the tactile dynamic threshold method, most of the work done is the same, with the following exceptions; these things are done differently since in the tactile application, different types of possible errors are more important to minimize than in the vocoding application of the method. In this variant, the dynamic threshold is preferably set to the successful candidate's score, instead of twice or three times that much, which allows the occasional hit right after a candidate, if the new candidate is larger than the old. For this case, everything is reset to declare the new hit as the actual pitch pulse, and all the timing variables are reset except that it doesn't produce another toggle of the divide by two counter used in the tactile application, since the previous false hit accomplished that already.

Turning now to FIG. 5, the second procedural flow chart illustrates the second example of the method for identifying pitch pulses for tracking pitch. The method of the present invention is embodied in the C language program listing attached hereto and identified as Appendix A. Returning to FIG. 5, however, the method begins at, and spends most of its time waiting in, block 200 for the next sample from the a/d converter, or from a disk file (if that is the proximate data source, for instance). When a sample arrives, flow moves to block 201 where its sign is tested to see if it matches the polarity chosen by the method implementor (positive is assumed for the purposes of the description, however, the method can work on either polarity, or be duplicated for both at once). If the sample sign does match, flow moves to block 203 where the sample is tested against the previous input sample to determine if this is the start, or merely the continuation of a positive pulse. If it is the start of a new pulse, a candidate data structure is initialized with its energy sum equal to the sample value, and the width equal to 1 (in general, all times used in the method are normalized to and used as sample counts, since this is a computationally economical way to track time intervals when regular sampling is done), after which flow falls through to block 211, described later. If it is not the start of a new pulse, flow goes to block 205, where the sample is added to the energy sum of the candidate already in progress, and the candidate's width variable is incremented, after which control falls through to block 211.

If, in block 201, the sample sign does not match the polarity of pulse being looked for, flow moves to block 202 where the sample is compared with the previous sample to determine if this sample represents a zero crossing. If not, flow falls through to block 211, described later. If the sample does represent the first sample after a zero crossing, it means that the candidate in progress has just finished, and so flow moves to block 204. In this block, the candidate's energy sum is divided by its width so as to make it more a measure of its shape-match to a square pulse, rather than simply a measure of its average energy—one of the keys of the method. Since we are only interested in matching a square shape, E.G. one in which all values are either zero or some equal non-zero number, the number 1.0 is assumed to be the square pulse's amplitude to avoid the need to do any multiplications. This metric is used as the candidate score. Once this has been done, the candidate is exposed to defensive tests (as discussed above) to determine if it is indeed a pitch pulse. If it fails any of these tests, control flow falls through to block 211. When a candidate has been finalized, it needs to be tested against the various measures and thresholds to determine if it is a genuine pitch pulse hit. The tests begin in block 207, where the candidate's width is tested against limits that normal speech can produce, the numbers of the present example being in the range of approximately 0.4ms for the minimum width, and approximately 7 ms for the maximum width. Other numbers may be used if it is desired to either specialize the method for a particular speaker, or if the method is being used on a non-speech signal. The effect is that of rejecting too-high or too-low frequency components without having to actually do any spectral analysis of the input signal, making the method more computationally efficient. If the candidate fails this (or any other) test, flow falls through to block 211. If the candidate passes the width tests, flow continues to block 208, where the time since the last successful candidate is tested against a minimum period value, usually taken to be approximately 2 ms, for speech, thereby rejecting candidates that come too frequently to be genuine pitch pulses. If the candidate fails this test, it is rejected, and flow falls through to block 211. In the tactile-aid method (as opposed to the vocoder method), this test simply indicates that the previous hit was a false one if the current score is higher than the previous score. In that case, all the timing values are reset and recomputed, but a new pitch pulse is not declared, since the previous false hit already declared one, and for the tactile-aid application the total number of hits is more important than getting each one exact. The timing values are recomputed for that case (as in block 210), however, to help avoid further false hits entirely. If the candidate passes the minimum-period test in block 208, flow moves to block 209, where the candidate's score is compared to the current threshold. Two tests are made in this block. One is a simple comparison of the candidate score to the current dynamic threshold value, and if the candidate passes this test, it is successful. However, another test may allow the candidate to be declared successful if it falls very close to the time a pitch pulse was expected, based on a measure of estimated current pitch the method maintains. If the candidate timing is such that it falls within plus or minus ⅙th of the expected pitch period, it is compared to the dynamic threshold divided by 8. This allows the method to freewheel through temporary amplitude dropouts that occur naturally and commonly in speech during voiced consonants. This represents a major improvement over other techniques, since it allows the method to keep the threshold higher at most times and avoid false hits that other methods incur if they attempt to decay the threshold fast enough to handle this case. If the candidate score passes either of these tests, it is declared a successful candidate, and flow moves to block 210, where the successful candidate processing steps are done. In block 210, the current candidate is declared successful, and so this is the time where various estimates are recomputed and values are reset. Firstly, a Boolean flag, used by whatever process needs pitch tracking done, is set to indicate that a pitch pulse occurred at this sample. The using process is responsible for clearing this flag after doing whatever it does. The process can discover the precise starting sample of the actual pitch pulse by subtracting the current candidate's width from the current sample number. This is very useful for the vocoding application, which can now use the previous two sample indexes of pitch periods to recover a precisely defined, single pitch period of data from a buffer of previous samples that the vocoder process has been keeping, with benefits described elsewhere in this document. To continue successful candidate processing, the period counter is reset to zero, so it will be ready to time the period until the next candidate. The pitch estimate maintained by the process is now updated in one of two different ways, depending on how much "confidence" exists in the current candidate. If the candidate occurred within a time window around when the method expects a candidate (the same window used in block 209) and its score was above the dynamic threshold without dividing it by 8, the method declares perfect confidence, and the estimate of current pitch is simply set to the last pitch interval. If either of these tests is not true, the current period is weighted-averaged with the existing estimate so that the current period has a weight of 20% and the existing estimate has a weight of 80%, although different numbers may be used here as long as the weights add to 100%, giving, in effect, a first order low-pass filter for the current pitch estimate. Once this has been updated, a new blanking time is computed based on the percentage blank time parameter (usually taken to be between 40% and 65%) and the current estimate, and this number is stored for dynamic threshold maintenance in block 211. While still in block 210, a new exponential decay multiplier is calculated as the power of the decay amount raised to the difference between the blanking time and the expected period time. Here is the actual line of c code (as seen in Appendix A):

```
DynDecay=pow(Params.Decay*percentscale,1.0/decaytime);//compute decay multiplier
```

Where DynDecay is the value multiplied by the dynamic threshold to decay it, Params.Decay is the percent decay desired, percentscale is 0.01, and the decaytime variable is the expected period minus the blanking interval, in samples. At this time, the dynamic threshold is set to a value of 2 or 3 times the successful candidate's score (e.g., as shown in FIGS. 4*b* and 4*c*) to provide blanking during the blanking interval, but still allow a very large score to re-trigger the process. In the tactile aid application, a candidate that occurs within this blanking interval resets all the timing numbers but doesn't declare a new pitch pulse, so as to keep the total count accurate, but also to gain synchronization with the real pitch pulses, rather than what must be assumed to have been a false early hit.

All control flows eventually wind up at block 211, where any user process, such as a vocoder or tactile-aid output generator, has the chance to do some processing based on whether a pitch pulse exists, and where the dynamic threshold is updated, and the period counter counted. Dynamic threshold maintenance is complex, and proceeds as follows. If the period counter is less than the desired blanking interval, no change is made to the dynamic threshold—it simply stays at the multiple of the previous candidate's score it was set to in block 210. If, however, the period counter is equal to the blanking time, the dynamic threshold is set to the previous candidate's actual score. If the period counter is greater than the blanking time, but less than 1.5 times the expected period, the dynamic threshold is multiplied by the decay multiplier computed in block 210 to decay it exponentially. If the period counter is greater than 1.5 times the expected period, the dynamic threshold is instead multiplied by a slower decay factor instead, to prevent it going so low so quickly so as to pick up small unvoiced sounds or channel noise in the normal pauses in speech. This latter slow decay factor is computed similarly to the DynDecay above, but using approximately a 1.5 second timing value instead to create a very slow decay. Finally, the dynamic threshold is compared against a preset minimum value which is implementation dependent, to simply reject very-low level candidates, such as might be produced by a/d conversion or channel noise artifacts. The reference implementation, which uses a high quality, low noise 16 bit a/d converter, uses the value of 100 a/d counts for this preset number to reject system noise. If the decay process(es) have decayed the dynamic threshold below this value, it is simply set to the preset value. Lastly, the period counter is incremented, since another sample has passed. At this point, the control loops back up to block 200 to await the next sample.

Generally, once a pitch pulse has been identified with a hit, speech pitch or frequency (F0) is analyzed for pitch tracking. With a more accurate input indication of pitch (F0), some rather simple error defense algorithms can be used to produce a nearly perfect tracking of pitch (F0) on a pitch-pulse by pitch-pulse basis. Using the method of the present invention, one can track pitch on a pulse-by-pulse basis, accurately enabling pitch synchronous harmonic analysis and making formant tracking easy. This result enables a large new class of applications for vocoding, the Internet phone for instance; such new devices can operate much closer to real time than existing (e.g., military) vocoders, and also can have better voice quality at low bit rates than is currently possible using existing technology.

The method of the present invention enables production of a pitch pulse processor for processing speech signals having less memory and a more modest microprocessor than would be possible using previous methods. Saving silicon is extremely important in embedded signal processing applications. A large telecommunications manufacturer typically employs acres of robots working around the clock to produce telecommunications equipment, and so a savings of even five cents per item adds up to a substantial sum.

Telephone system providers, such as MCI, Inc. (a company reportedly buying several half-million dollar Wavelength Division Multiplexors (WDMs) to increase the effective bandwidth of their fibers) has ample economic incentive to avoid the cost ($77K/mile/fiber) associated with laying new fiber-optic cable. The method of the present invention is the particularly well suited to making best use of the fiber optic cable's available bandwidth. The application of the method of the present invention is likely to prove extremely desirable to telephone system providers, since a low-bandwidth vocoder equipped system having pitch pulse processors on first and second ends can provide substantial savings, as compared to prior art technologies.

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention as defined by the appended claims.

APPENDIX A

```
Demonstration of the method implementation in computer C code
Variable definitions:
caninprog, boolean -- if true, a candidate is in progress, eg we're add
ing samples to it
goodcan, boolean -- if true, we just declared the current candidate a p
itch pulse.
cleared elsewhere after any other processing we do for a good pitch pul
se.
Can -- a structure that contains information about this candidate
minper,maxper -- integers that define the maximum and minimum allowed p
eriods (in samples)
canminwidth, canmaxwidth -- integers the define the maximum and minimum
allowed candidate
width, in samples.
expectpercd -- an integer that contains the estimate of the current pit
ch rate, in samples.
samplessince -- an integer that counts each sample how long it's been s
ince the last pitch pulse.
Dyndecay,SloDecay -- float, multipliers that determine decay rate of dy
nthresh
dynthresh -- float, the dynamic threshold used to determine if a candid
ate is 'square' and energetic enough
decaytime, integer -- when to start decaying dynthresh
//////////////////////////////////////////////////////////////////////
//////////
    // pitch tracker, called for each sample
    if (Samp > 0) // if this sample is positive
     if (caninprog)
         { // add to current candidate
       Can.Sum += Samp;
         Can. Width++;
         } else
         {// start another one
         caninprog = TRUE; // starting a new one
         Can.StartSample = FileIndex + i; // where we really are in the
data
         Can.Width = 0;
         Can.Sum = 0;
         Can.Energy = 0;
         Can.Period = 0;
         }// start a new can
    }else // see if first neg sample, and act accordingly
    {
    if (caninprog)
         {
     caninprog = FALSE;// must've just ended
```

APPENDIX A-continued

```
    if (Can.Width > canminwidth && Can.Width < canmaxwidth) // if this
 isn't surely out of band noise
    {
        Can.Energy = (float) Can.Sum/ (float) Can.Width;
    if (samplessince >= minper) // most of them will be ringing durin
g a pitch period
        { // if we're not too high a rate
        if (Can.Energy > dynthresh || (abs(expectpercd - samplessinc
e). < (expectpercd/6) && Can.Energy > dynthresh/8))
        { // eg, if we're sure, or if there's anything really close,
 kinda pll-like, drop threshold
        // momentarily very low right around when we expect a pulse so
 as to miss nothing real
        goodcan = TRUE; // for later use
        Can.Period = samplessince; // might want this later
        if (samplessince <= maxper)
            { // if we're sure, jam-update expectation, else start
tracking towards new stuff slowly
            if (Can.Energy > dynthresh) expectpercd = samplessince
; // jam it, else
            else expectpercd = 0.8f * expectpercd + 0.2f * samples
since; //average this
            }
        dynthresh = Can.Energy * 2;// how we accomplish blanking
        blanktime = Params.BlankTime * percentscale * expectpercd;
        decaytime = expectpercd - blanktime; // decay only starts __
after__ blanking
        DynDecay = pow(Params. Decay * percentscale, 1.0/decaytime);
// the magic decay multiplier
        samplessince = 0; // so can count how long we're waiting be
tween them -- pitch period
        memcpy(&ZCan,&DoneCan,sizeof(PitchCan)); // save the previo
us one
        memcpy(&DoneCan,&Can,sizeof(PitchCan)); // save this one
        { // if good energy
        }       // if greater than minimum period else, blank resync?
      }// if good width
     }// if candidate was in progress, else skip this
    }// else first negative sample -- check candidate
if (goodcan)
{
// do any "goodcan" processing here and set goodcan false when that's d
one
goodcan = FALSE; // so we'll only see the pitch pulse one time thru
}
//*************************************
// dynamic threshold maintenance between candidates
    if (samplessince == blanktime) dynthresh = DoneCan.Energy; // come d
own off the blanking pedestal
    if (samplessince > blanktime && samplessince < expectpercd * 1.5) //
  stop decaying fast at 1.5 times the expectation
        dynthresh *= DynDecay; // decay to the requested percent of
previous candidate by the time we expect another
    if (samplessince > expectpercd*1.5 && dynthresh > Params.MinAmp) dyn
thresh *= SloDecay; // bleed off thresh
    if (dynthresh < Params.MinAmp) dynthresh = Params.MinAmp;// but don'
t bleed to 0
    samplessince++;// count samples since last hit for other stuff to us
e -- where we are kinda
// go wait for another sample to come in and call this again when it do
es
```

What is claimed is:

1. A method for tracking pitch of an analog signal from a selected source process characterized by a pitch source having many harmonics followed by a bandpass filtering, such as human speech or other common processes, comprising:

(a) sampling the source process analog signal at a selected periodic sampling rate to generate a plurality of source signal samples having amplitude values;

(b) quantizing the source signal samples to generate a plurality of digitized source signal samples, wherein each digitized source signal sample has a digitized amplitude value;

(c) identifying the boundaries of a first candidate pulse by identifying the digitized source signal samples lying between first and second zero crossings;

(d) measuring the first pulse width from the digitized source signal samples lying between the first and second zero crossings to generate a first candidate pulse width corresponding to the number of digitized source signal samples lying between zero crossings;

(e) summing the digitized amplitude values for the digitized source signal samples identified as lying between the zero crossings to generate a first candidate pulse digitized amplitude value sum;

(f) dividing the first candidate pulse digitized amplitude value sum by the first candidate pulse width to generate a first candidate score;

(g) setting a candidate score threshold to the first candidate score;

(h) identifying the boundaries of a second candidate pulse by identifying the digitized source signal samples lying between third and fourth zero crossings;

(i) measuring the second pulse width from the digitized source signal samples lying between the third and fourth zero crossings to generate a second candidate pulse width corresponding to the number of digitized source signal samples lying between zero crossings;

(j) summing the digitized amplitude values for the digitized source signal samples identified as lying between the zero crossings to generate a second candidate pulse digitized amplitude value sum;

(k) dividing the second candidate pulse digitized amplitude value sum by the second candidate pulse width to generate a second candidate score;

(l) selecting the larger of said first candidate score and said second candidate score to identify a pitch pulse, and (m) setting the candidate score threshold to the pitch pulse candidate score.

2. The method of claim 1, wherein step (d) further includes:

(d.1) determining whether the first candidate pulse width corresponding to the number of digitized source signal samples lying between zero crossings is greater than seventeen milliseconds; and wherein step (f) further includes:

(f.1) generating a first candidate score of zero in response to determining the first candidate pulse width corresponding to the number of digitized source signal samples lying between zero crossings is greater than seventeen milliseconds.

3. The method of claim 1, wherein step (i) further includes:

(i.1) determining whether the second candidate pulse width corresponding to the number of digitized source signal samples lying between zero crossings is greater than seventeen milliseconds; and wherein step (k) further includes:

(k.1) generating a second candidate score of zero in response to determining the second candidate pulse width corresponding to the number of digitized source signal samples lying between zero crossings is greater than seventeen milliseconds.

4. The method of claim 1, wherein step (d) further includes:

(d.1) determining whether the first candidate pulse width corresponding to the number of digitized source signal samples lying between zero crossings is less than three milliseconds; and wherein step (f) further includes:

(f.1) generating a first candidate score of zero in response to determining the first candidate pulse width corresponding to the number of digitized source signal samples lying between zero crossings is less than three milliseconds.

5. The method of claim 1, wherein step (i) further includes:

(i.1) determining whether the second candidate pulse width corresponding to the number of digitized source signal samples lying between zero crossings is less than three milliseconds; and wherein step (k) further includes:

(k.1) generating a second candidate score of zero in response to determining the second candidate pulse width corresponding to the number of digitized source signal samples lying between zero crossings is less than three milliseconds.

6. A method for tracking pitch of an analog signal from a selected source process characterized by a pitch source having many harmonics followed by a bandpass filtering, such as human speech or other common processes, comprising:

a) sampling the source process analog signal at a selected periodic sampling rate to generate a sampled source signal having sample amplitude values;

b) quantizing the sampled source signal generate a of digitized source signal having a plurality of digitized samples with digitized amplitude values;

c) identifying the boundaries of a first candidate pulse by identifying the digitized samples lying between first and second zero crossings;

d) measuring the first pulse width by counting the digitized samples lying between the first and second zero crossings to generate a first candidate pulse width;

e) generating a first square pulse having a width equal to the first candidate pulse width;

f) convolving the digitized samples of the first candidate pulse with the first square pulse to generate a first candidate score;

g) setting a candidate score threshold to the first candidate score;

h) identifying the boundaries of a second candidate pulse by identifying the digitized samples lying between third and fourth zero crossings;

j) measuring the second pulse width by counting the digitized samples lying between the third and fourth zero crossings to generate a second candidate pulse width;

k) generating a second square pulse having a width equal to the second candidate pulse width;

l) convolving the digitized samples of the second candidate pulse with the second square pulse to generate a second candidate score;

m) selecting the larger of said first candidate score and said second candidate score to identify a pitch pulse, and n) setting the candidate score threshold to the pitch pulse candidate score.

7. The method of claim 6, wherein step (d) further includes:

(d.1) determining whether the first candidate pulse width corresponding to the number of digitized source signal samples lying between zero crossings is greater than seventeen milliseconds; and wherein step (f) further includes:

(f.1) generating a first candidate score of zero in response to determining the first candidate pulse width corresponding to the number of digitized source signal samples lying between zero crossings is greater than seventeen milliseconds.

8. The method of claim 6, wherein step (i) further includes:

(i.1) determining whether the second candidate pulse width corresponding to the number of digitized source signal samples lying between zero crossings is greater than seventeen milliseconds; and wherein step (k) further includes:

(k.1) generating a second candidate score of zero in response to determining the second candidate pulse width corresponding to the number of digitized source signal samples lying between zero crossings is greater than seventeen milliseconds.

9. The method of claim 6, wherein step (d) further includes:

(d.1) determining whether the first candidate pulse width corresponding to the number of digitized source signal samples lying between zero crossings is less than three milliseconds; and wherein step (f) further includes:

(f.1) generating a first candidate score of zero in response to determining the first candidate pulse width corresponding to the number of digitized source signal samples lying between zero crossings is less than three milliseconds.

10. The method of claim 6, wherein step (i) further includes:

(i.1) determining whether the second candidate pulse width corresponding to the number of digitized source signal samples lying between zero crossings is less than three milliseconds; and wherein step (k) further includes:

(k.1) generating a second candidate score of zero in response to determining the second candidate pulse width corresponding to the number of digitized source signal samples lying between zero crossings is less than three milliseconds.

* * * * *